United States Patent [19]

Hool

[11] 4,359,837

[45] Nov. 23, 1982

[54] LABYRINTH CRIB TOY

[76] Inventor: Sherman W. Hool, 1617 - 4th St., San Rafael, Calif. 94901

[21] Appl. No.: 219,403

[22] Filed: Dec. 22, 1980

[51] Int. Cl.[3] ..... A63H 33/00

[52] U.S. Cl. ..... 46/43

[58] Field of Search ..... 46/43, 42, 40; 273/120 R, 121 E, 121 R, 86 C

[56] References Cited

U.S. PATENT DOCUMENTS

| | | | |
|---|---|---|---|
| 1,258,845 | 3/1918 | Wilkins | 46/40 |
| 2,522,133 | 9/1950 | Sanders | 46/43 |
| 2,568,908 | 9/1951 | Blaich et al. | 46/42 |
| 3,281,985 | 11/1966 | Einfalt | 46/43 X |

*Primary Examiner*—Robert Peshock
*Assistant Examiner*—Mickey Yu
*Attorney, Agent, or Firm*—Townsend and Townsend

[57] ABSTRACT

A crib toy is disclosed having a labyrinth for the passage of a ball from an elevator unloading station of high gravitational potential to an elevator loading station of low gravitational potential. At the loading station, the ball is blocked by a weighted lever awaiting the presence of the elevator car. The car when present overcomes bias of the lever and allows the ball to pass into the car. The lever biases the car to be loaded with respect to an elevator shaft for ball loading. When the elevator is raised to the unloading station of high gravitational potential, an overcenter pulley cants the car and expels the ball. The labyrinth, typically provided with one transparent wall and a series of serpentine gravitationally biased paths, then causes the balls to pass along a circuitous and amusing path. Operation of the disclosed weighted lever prevents jamming of the elevator shaft path with the presence of the ball to provide an amusing and foolproof toy which can be operated by infants.

3 Claims, 4 Drawing Figures

LABYRINTH CRIB TOY

This invention relates to a crib toy and more particularly to a gravitationally biased labyrinth passageway for a ball operated by an interlocked elevator device.

SUMMARY OF THE INVENTION

Toys having elevator cars and gravitationally biased labyrinths are known. See for example W. J. Sanders U.S. Pat. No. 2,522,133, entitled "Gravity Type Rolling Ball Game Device".

Such devices are preferably operated by adults because of operational difficulties. One of the operational difficulties of such devices when encountered is the tendency of the operator to leave the elevator car in the elevated position and to have balls completing their flow course through the labyrinth fall into the path of the elevator.

In the environment of the disclosed crib toy, this is unsatisfactory. It is common for a child, watching in fascination as the ball traverses the labyrinth path, to maintain the elevator car in an elevated position. The lower loading station of the elevator typically has the ball fall into the path of the elevator. When the car descends to pick up and transport the ball from the lower loading station to the upper unloading station, the ball blocks the path of the car. The game becomes inoperative until an adult can "come to the rescue" and recycle the game as by tilting the whole apparatus to free the full path of the elevator car. As a consequence, such labyrinth toys have not heretofore been adapted to a crib environment.

SUMMARY OF THE INVENTION

A crib toy is disclosed having a labyrinth for the passage of a ball from an elevator unloading station of high gravitational potential to an elevator loading station of low gravitational potential. At the loading station, the ball is blocked by a weighted lever awaiting the presence of the elevator car. The car when present overcomes bias of the lever and allows the ball to pass into the car. The lever biases the car to be loaded with respect to an elevator shaft for ball loading. When the elevator is raised to the unloading station of high gravitational potential, an overcenter pulley cants the car and expels the ball. The labyrinth, typically provided with one transparent wall and a series of serpentine gravitationally biased paths, then causes the balls to pass along a circuitous and amusing path. Operation of the disclosed weighted lever prevents jamming of the elevator shaft path with the presence of the ball to provide an amusing and foolproof toy which can be operated by infants.

OBJECTS, FEATURES AND ADVANTAGES

An object of this invention is to adapt a crib labyrinth toy to a crib environment. According to this aspect of the invention, an elevator shaft is provided having at its lower end a car loading station, at its upper end a car unloading station. An elevator car typically operated by pulling on a string traverses betwen the loading station and the unloading station. By the movement of the car from the loading station to the unloading station, downward passage over an extended period of time of a ball can be made to the amusement of a child operator, such as a child in a crib.

A further object of this invention is to disclose in such a crib operated toy a safeguard against blocking of the device. According to this aspect of the invention, a gravity biased lever is placed at the elevator car loading station. When the car is elevated and the ball attempts entrance to the loading station, the lever bias prevents entrance of the ball to the loading station. When the elevator car is lowered, the bias of the lever is overcome. The car thus clears the lever and clears the path for the ball to roll into the car for the next cycle of the apparatus.

A surprising advantage of the disclosed elevator loading station interlock is that the elevator car is biased to a loading disposition by the lever. Consequently, when the ball enters the car at the loading station, it is gravitationally biased to a position where it may subsequently be elevated. Simple operation of the disclosed toy results.

Other objects, features and advantages of this invention will become more apparent after the referring to the following specification and attached drawings in which.

Figure 1A:
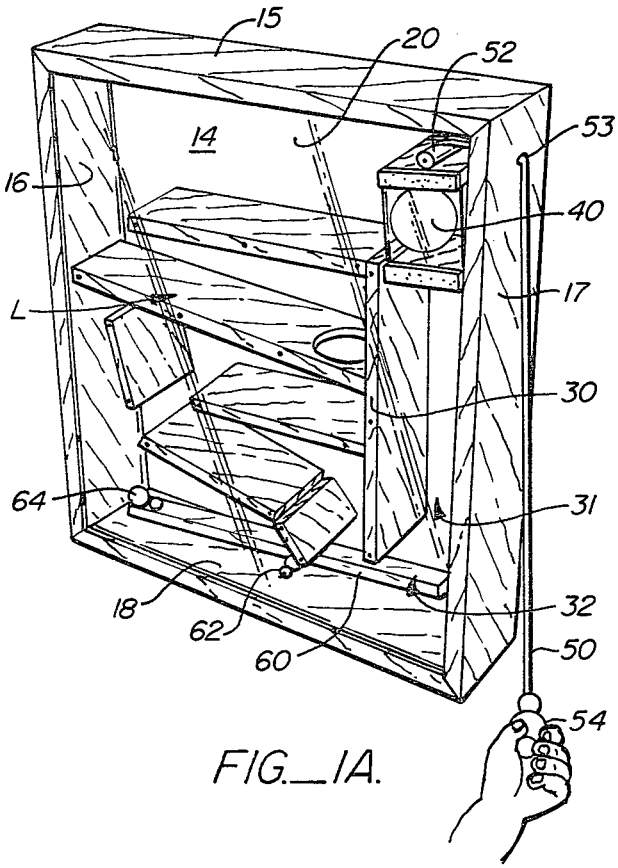
FIG. 1A is an enlarged perspective view of the toy illustrating the elevator car at the upward position biased over center to expel the ball.

Referring to FIG. 1A, this invention consists of a rectangular box having a back wall 14 and four side walls 15, 16, 17, 18. These respective walls are mounted in frame-like fashion with suitable routed groups to capture opaque rear wall 14 and additionally to capture in a picture frame fashion transparent wall 20 therebetween.

Figure 2:
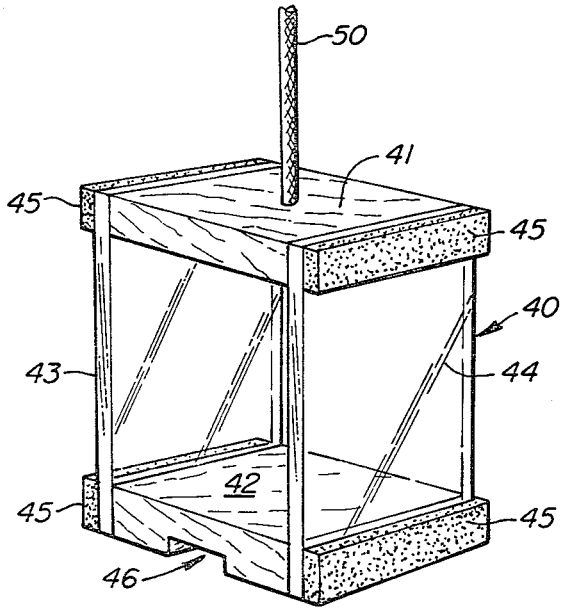
FIG. 2 is a detail of the elevator car.

A vertical board 30 forms between side wall 17 and wall 30 an elevator shaft 31. Shaft 31 has a lower loading station 32 and an upper discharge station 33. An elevator car 40 is illustrated in FIG. 2 for movement along the shaft between the stations. The car has a top 41, a bottom 42 and two transparent side walls 43, 44 therebetween. The transparent side walls in combination with the transparent wall 20 provide to the viewer a visual indication of the passage of the ball. To prevent scarring or marking of the transparent wall 20, by elevator car 40, there is provided felt runner strips 45 at the edges of the elevator.

In bottom 42 there is provided a lever receiving notch 46. The purpose of the lever receiving notch will become more apparent in the following discussion of the operation of this device.

Raising and lowering of the elevator car is made through a cord 50. Cord 50 passes over a pulley bar 52 thence outwardly through hole 53 in wall 17 to a cord attached bead 54. By pulling down on the cord attached bead 54, cord 50 is actuated to raise and lower the car.

It will be observed that the elevator shaft 31 defined between board 30 and wall 17 is slightly greater in dimension than the car 40. This being the case, and wherein the pulley 52 is placed in an overcenter position to and towards board 30, the car in the unloading station 33 cants to an overcenter disposition where it expels the ball to and towards the labyrinth.

When car 40 is in the lower position, the car 40 is also capable of being canted in the opposite direction. Here, however, it is not the cord and over center pulley that cants the ball. Instead, it is groove 46 on car 40 coming into contact with lever 60. This function can be easily understood first with reference to FIG. 1A and then with reference to FIG. 1C.

Turning to FIG. 1A, it will be seen that there is provided a balanced lever 60 at the bottom of the car. Lever 60 includes a pivot 62 and a weight 64 at one end of the lever. Weight 64 is of sufficient mass that lever 60 is biased to the upward position.

Figure 1B:
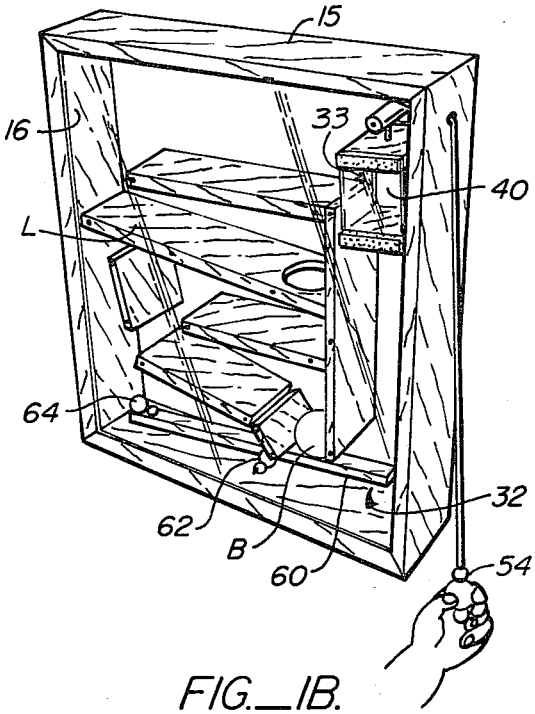
FIG. 1B is a view similar to FIG. 1A on a reduced scale illustrating the ball blocked by the lever device of this invention from passing into a position where it blocks the downward path of the elevator car.

Additionally, and referring to FIG. 1B, assuming that the elevator car 40 is in the upward position, it will be seen that lever 60 and its weight 64 are of such mass with respect to pivot 62 that the ball B is prevented from entering the lower ball loading station 32.

Figure 1C:
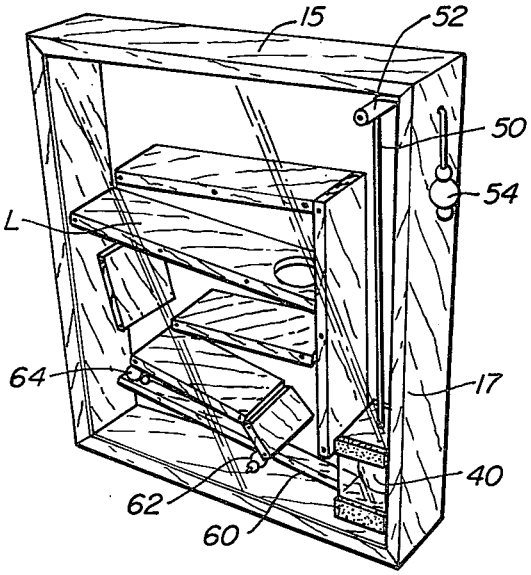
FIG. 1C is a view similar to FIG. 1B illustrating the ball within the elevator car prior to being hoisted.

Referring to FIG. 1C, when the elevator car 40 is lowered, then and only then is the bias of lever 60 overcome so that mass 64 on the lever 60 is permitted to rise as the bar 60 pivots about pivot point 62. At this point, bar 60 forms an incline path guiding the ball to the elevator car. At the same time, the reception of the bar 60 into the groove 46 cocks the car 40 within the elevator shaft. As the car 40 is cocked within the elevator shaft by the bar from the ball receiving side, the bias of the elevator car 40 is to and towards the wall 17. When the elevator car is subsequently raised by grasping of the attached beads at beads 54 to the string 50, the ball remains in the car and the operative cycle occurs.

The operation of the invention is easy to understand. Referring to FIG. 1A, the car is raised, pulled immediately adjacent the overcenter pulley and expelled into the labyrinth L. The ball completes its circuitous passage through the labyrinth L to the loading station at the lower end of the elevator shaft 31. This can be seen in FIG. 1B.

Upon arrival at the loading station, the ball's path is blocked. This being the case, the ball may not move into a path where it will obstruct the downward passage of the elevator car 40.

Finally, when the elevator car passes downwardly, two things occur. First, the elevator car 40 depresses the lever 60. The ball is free to roll within the elevator car, along the length of the depressed bar 60.

Secondly, the elevator car is canted. It is canted so that it's bottom surface 42 is biased to and towards wall 17.

Finally, when the cord 50 is grasped at attached bead 54 and the car pulled upwardly, the cycle is repeated.

It will be seen that the disclosed invention sets forth a simple and expedient crib toy. Operation of the toy is essentially fool-proof and can be operated by the smallest of infants without jamming of the device.

What is claimed is:

1. In a gravitational labyrinth toy having a circuitous group of passageways defining a path for a ball extending between a ball unloading station at the top portion of said labyrinth and a ball loading station at the bottom portion of said labyrinth, with an elevator for transporting said ball upwardly between said stations, the improvement in said loading station comprising: a balanced pivot lever disposed proximate said ball loading station, said balanced pivot lever having a medial pivot, a first end with a weight thereon, a second end for moving into the path of said ball, said first end having sufficient mass to maintain said second end of said balanced pivot lever in an obstructing position to said loading station to prevent movement of said ball to said loading station, said second end of said balanced pivot lever defining an obstructing upslope path for halting the downward passage of said ball in said gravitational labyrinth; said elevator and ball having sufficient mass to overcome the bias of said first end and cause said balanced pivot lever to pivot so that said second end defines a loading downslope path for permitting said ball to move into said elevator when said elevator is present at said loading station.

2. The invention of claim 1 and wherein said elevator moves in a elevator shaft and said elevator shaft has a section larger than said elevator so that said elevator is biased by said balanced pivot lever to a tilted position to bias said ball into said elevator.

3. The invention of claim 1 and including a pulley disposed above the upward end of said path, said pulley being over-center with respect to the elevator shaft to permit said elevator to be biased to exspell said ball when pulled at the upper end of said shaft.

* * * * *